US009279610B2

(12) United States Patent
Wang et al.

(10) Patent No.: US 9,279,610 B2
(45) Date of Patent: Mar. 8, 2016

(54) STORAGE SYSTEMS FOR MILK BAGS

(71) Applicants: Tina Ting-Yuan Wang, Cupertino, CA (US); Chih-Cheng Tai, Campbell, CA (US); Michael Clair Houston, Cupertino, CA (US)

(72) Inventors: Tina Ting-Yuan Wang, Cupertino, CA (US); Chih-Cheng Tai, Campbell, CA (US); Michael Clair Houston, Cupertino, CA (US)

( * ) Notice: Subject to any disclaimer, the term of this patent is extended or adjusted under 35 U.S.C. 154(b) by 0 days.

(21) Appl. No.: 14/590,187

(22) Filed: Jan. 6, 2015

(65) Prior Publication Data

US 2015/0176889 A1 Jun. 25, 2015

Related U.S. Application Data

(62) Division of application No. 13/913,253, filed on Jun. 7, 2013, now Pat. No. 8,955,696.

(60) Provisional application No. 61/657,474, filed on Jun. 8, 2012.

(51) Int. Cl.

| | |
|---|---|
| ***A47F 1/04*** | (2006.01) |
| ***F25D 25/02*** | (2006.01) |
| ***A47F 7/00*** | (2006.01) |
| ***F25D 25/00*** | (2006.01) |
| ***A47B 45/00*** | (2006.01) |
| ***A47B 75/00*** | (2006.01) |
| ***A47B 96/02*** | (2006.01) |

(52) U.S. Cl.

CPC ..... *F25D 25/02* (2013.01); *A47B 45/00* (2013.01); *A47B 75/00* (2013.01); *A47B 96/021* (2013.01); *A47F 7/0014* (2013.01); *A47F 7/0071* (2013.01); *F25D 25/005* (2013.01)

(58) Field of Classification Search

CPC ..... F25D 25/02; F25D 25/005; A47F 7/0071; A47F 7/0014; A47B 45/00; A47B 75/00; A47B 96/021

USPC ..... 220/6, 666; 426/111, 112; 383/38, 2; 229/67.3; 206/541–549

See application file for complete search history.

(56) References Cited

U.S. PATENT DOCUMENTS

| | | | | |
|---|---|---|---|---|
| 234,297 | A | 11/1880 | Lambert | |
| 460,748 | A | 10/1891 | Hartmann | |
| 585,099 | A | 6/1897 | Helbach | |
| 1,185,677 | A | 6/1916 | Jargstorf | |
| 1,231,626 | A | 7/1917 | Lee | |
| 1,270,354 | A * | 6/1918 | Woodrum | 232/43.1 |
| 1,367,948 | A | 2/1921 | Curtin | |
| 1,444,811 | A * | 2/1923 | Tarbox | 229/67.3 |
| 1,458,953 | A | 6/1923 | Robeson | |
| 1,567,165 | A | 12/1925 | Noland | |

(Continued)

OTHER PUBLICATIONS

Notice of Allowance and Fees Due mailed on Feb. 27, 2014, U.S. Appl. No. 13/275,061, filed Oct. 17, 2011, Wang et al.

*Primary Examiner* — Joshua J Michener
*Assistant Examiner* — Devin Barnett

(57) ABSTRACT

Embodiments of the present invention are directed to storage systems for milk bags. A storage system for milk bags receives milk bags and management of the stored milk bags. The milk bags are stored in compartments for easy storage and retrieval.

13 Claims, 7 Drawing Sheets

(56) References Cited

U.S. PATENT DOCUMENTS 1,583,083 A * 5/1926 Macaraig ..... 220/9.2
1,636,838 A * 7/1927 Roser ..... 190/103
1,755,950 A * 4/1930 Dobson et al. ..... 248/97
1,808,475 A 6/1931 Oyen
1,833,081 A 11/1931 Kilmer
1,846,584 A * 2/1932 Clark ..... 229/87.03
1,847,066 A * 3/1932 Berg ..... 312/6
1,931,403 A 10/1933 Connor
2,073,636 A 3/1937 Holoubek
D104,413 S 5/1937 Smith
D112,751 S 12/1938 Bowes
2,171,760 A 9/1939 O'Brien
2,265,889 A * 12/1941 Belz ..... 206/353
2,357,339 A * 9/1944 Mathieu ..... 206/526
2,506,448 A 5/1950 Gregor
2,575,893 A * 11/1951 Seaman ..... 383/25
2,604,983 A 7/1952 Moore
2,662,638 A 12/1953 Storer et al.
2,685,316 A * 8/1954 Krasno ..... 206/524.8
2,728,623 A 12/1955 Foerstner
2,801,000 A 7/1957 Busch
2,845,185 A * 7/1958 Winderweedle, Jr ..... 108/164
2,893,550 A 7/1959 Sandmeyer
2,914,189 A 11/1959 Bishop et al.
2,915,353 A 12/1959 Michaelsen
3,050,228 A 11/1960 Lane
3,191,793 A * 6/1965 Morrison ..... 220/6
3,238,004 A 3/1966 Goebel
3,495,762 A * 2/1970 Verbic ..... 383/120
D222,096 S 9/1971 Brown
3,744,866 A 7/1973 Cook
3,989,080 A * 11/1976 Koszegi ..... 383/40
4,078,662 A 3/1978 Volland
D267,125 S 11/1982 Luoma
4,361,215 A * 11/1982 Sawai ..... 190/18 A
4,376,558 A 3/1983 Bandar
4,394,906 A * 7/1983 Hollenbeck ..... 206/525
4,424,687 A * 1/1984 Morgan ..... 62/457.1
4,506,790 A 3/1985 Muscari
4,640,418 A 2/1987 Lowry
4,646,922 A 3/1987 Smith
D292,134 S 9/1987 McDaniel, Sr.
4,708,248 A * 11/1987 Davis ..... 206/549
4,733,759 A * 3/1988 Shih-Chen ..... 190/18 A
4,744,464 A 5/1988 Noe
4,746,519 A * 5/1988 Wright et al. ..... 426/83
D297,476 S 8/1988 Ross et al.
4,771,900 A 9/1988 Leoncavallo et al.
4,773,515 A * 9/1988 Kotkins, Jr. ..... 190/103
4,883,169 A 11/1989 Flanagan, Jr.
4,883,675 A * 11/1989 Wernz ..... 426/120
4,936,377 A 6/1990 DeVogel et al.
4,953,673 A * 9/1990 Ambasz ..... 190/103
4,974,652 A * 12/1990 Lemler ..... 150/147
4,984,662 A * 1/1991 Jacober ..... 190/107
5,025,979 A * 6/1991 Dellacroce ..... 229/67.2
D322,697 S 12/1991 Nguyen
5,076,437 A 12/1991 Schindler
5,090,526 A * 2/1992 Jacober ..... 190/107
5,193,675 A 3/1993 Otis
D344,828 S 3/1994 Adams
5,311,995 A 5/1994 Terry
5,316,154 A 5/1994 Hajec, Jr.
5,328,258 A 7/1994 Scalise
5,474,204 A 12/1995 Sutyla
5,484,078 A 1/1996 Bronovicki
5,493,107 A 2/1996 Gupta et al.
5,515,999 A 5/1996 Jo
5,547,098 A 8/1996 Jordan
D376,882 S 12/1996 Cook
5,765,691 A * 6/1998 Hall ..... 206/579
5,894,780 A * 4/1999 Taniguchi ..... 71/9
5,921,408 A 7/1999 Groenewold et al.
5,980,002 A 11/1999 Crowe
D418,956 S 1/2000 Hampshire
6,012,581 A 1/2000 Galazzo
6,027,774 A 2/2000 Fine et al.
6,039,202 A 3/2000 Olstad et al.
6,047,842 A 4/2000 Feidt
6,047,938 A 4/2000 Mitchell
6,089,001 A 7/2000 Hurst
6,095,372 A 8/2000 Dorsey et al.
6,193,247 B1 * 2/2001 Spear et al. ..... 280/33.998
6,327,725 B1 * 12/2001 Veilleux et al. ..... 5/644
6,364,110 B2 * 4/2002 Johnson ..... 206/425
6,378,707 B1 4/2002 Taggert
6,390,573 B1 * 5/2002 Wang ..... 312/6
D458,429 S 6/2002 Lenard
6,494,224 B2 * 12/2002 Zheng ..... 135/125
6,626,006 B1 * 9/2003 Tedder ..... 62/457.7
6,648,153 B2 11/2003 Holmes
6,719,157 B2 * 4/2004 Stoddart et al. ..... 211/118
6,749,273 B1 6/2004 Peterson
6,763,678 B2 * 7/2004 Harper ..... 62/461
6,821,019 B2 * 11/2004 Mogil ..... 383/110
6,988,619 B2 1/2006 Klatt
7,021,437 B2 * 4/2006 Ghiassi ..... 190/103
7,086,510 B2 * 8/2006 Smith et al. ..... 190/103
7,153,025 B1 * 12/2006 Jackson et al. ..... 383/2
7,172,080 B2 2/2007 Rodriguez
7,234,608 B2 * 6/2007 Reed et al. ..... 220/571
7,390,011 B1 * 6/2008 Hem ..... 280/638
7,494,014 B2 2/2009 Martinez
D595,466 S 6/2009 Sofy et al.
7,597,208 B2 10/2009 Wang
7,621,439 B2 11/2009 McClure
7,681,728 B2 * 3/2010 Sabounjian ..... 206/278.1
7,891,678 B2 * 2/2011 Anderson et al. ..... 280/47.35
7,900,746 B2 3/2011 Fleming
7,958,920 B1 * 6/2011 Olsson ..... 150/112
7,992,770 B2 8/2011 Holley
8,235,225 B2 8/2012 Ye
8,550,264 B2 10/2013 Langtry et al.
D709,336 S * 7/2014 Liebenthal ..... D7/605
8,887,942 B2 * 11/2014 Miksovsky et al. ..... 220/521
2002/0063077 A1 5/2002 Ferger et al.
2002/0181806 A1 * 12/2002 Godshaw et al. ..... 383/6
2002/0190017 A1 12/2002 Stevens
2004/0081373 A1 * 4/2004 Nykoluk ..... 383/2
2004/0108288 A1 6/2004 Breymaier et al.
2004/0136621 A1 * 7/2004 Mogil ..... 383/110
2004/0154950 A1 8/2004 Flaig
2004/0188365 A1 9/2004 Forte
2004/0195195 A1 10/2004 Mason
2005/0023235 A1 2/2005 Rodriguez
2005/0074187 A1 * 4/2005 Sabounjian ..... 383/38
2005/0269229 A1 12/2005 Lowry
2006/0262996 A1 * 11/2006 Vazquez ..... 383/2
2007/0012635 A1 1/2007 Liu
2007/0023439 A1 * 2/2007 Vaughn ..... 220/592.03
2007/0053616 A1 * 3/2007 Plouff ..... 383/22
2007/0221597 A1 9/2007 Chen
2007/0223842 A1 * 9/2007 Sabounjian ..... 383/2
2008/0017650 A1 1/2008 Evans et al.
2008/0210697 A1 * 9/2008 Kessell et al. ..... 220/666
2009/0212056 A1 8/2009 Degorl
2009/0223850 A1 * 9/2009 Katzauer et al. ..... 206/427
2009/0255288 A1 10/2009 Jia
2009/0255936 A1 10/2009 Rabbit
2009/0278009 A1 11/2009 Nono et al.
2010/0026156 A1 2/2010 Leconte et al.
2010/0059514 A1 * 3/2010 Zheng ..... 220/9.2
2010/0147015 A1 * 6/2010 Vanderberg et al. ..... 62/457.7
2010/0155347 A1 6/2010 McConnell et al.
2010/0203199 A1 * 8/2010 Ferro ..... 426/111
2010/0270249 A1 10/2010 Iwasaki
2011/0036796 A1 2/2011 Chen
2011/0168720 A1 7/2011 Mesman
2012/0047934 A1 3/2012 Park et al.
2012/0055895 A1 3/2012 Henn, Jr.
2012/0145718 A1 6/2012 Quarry et al.
2012/0247995 A1 10/2012 Charles
2012/0273505 A1 * 11/2012 Bose ..... 220/592.16
2012/0285912 A1 11/2012 Koessl

(56) References Cited

U.S. PATENT DOCUMENTS

2013/0153584 A1* 6/2013 Balleck ..... 220/592.01
2013/0264351 A1 10/2013 Bogdziewicz et al.
2014/0014550 A1 1/2014 Barrow
2015/0034661 A1* 2/2015 Cooper et al. ..... 220/666
2015/0072052 A1* 3/2015 Bartoli et al. ..... 426/112

* cited by examiner

STORAGE SYSTEMS FOR MILK BAGS

RELATED APPLICATIONS

This application is a divisional application which claims priority under 35 U.S.C. section 121 of U.S. patent application Ser. No.13/913,253, filed Jun. 7, 2013, entitled "Storage Systems for Milk Bags," which in turn claims benefit of priority under 35 U.S.C. section 119(e) of U.S. Provisional Patent Application Ser. No. 61/657,414, filed Jun. 8, 2012, entitled "Storage System for Milk Bags." This application incorporates both U.S. patent application Ser. No. 13/913,253, filed Jun. 7, 2013, entitled "Storage Systems for Milk Bags," and U.S. Provisional Patent Application Ser. No. 61/657,414, filed Jun. 8, 2012, entitled "Storage System for Milk Bags," in their entirety by reference.

FIELD OF THE INVENTION

The present invention is related to the field of storage systems. More specifically, the present invention relates to storage systems for milk bags.

BACKGROUND OF THE INVENTION

Breast milk can be frozen up to many months before it is used. Breast milk can be stored in milk bags. FIG. 1 illustrates an exemplary milk bag 100. A milk bag 100 is similar to a Ziploc® bag, in which it has a fastener 105 to close the milk bag 100 and to separate a tag 110 from the storage or bag area 115. Milk is contained in the storage area 115. Typically, the tag 110 allows for information to be written onto, such as name, date and amount of milk is in the milk bag.

In FIG. 1, the milk bag 100 has dimensions A and B as shown. Typically, the width of the milk bag 100 at the bottom is bigger than the width of the milk bag 100 at the top, so that the milk bag 100 can be positioned vertically in the freezer. One problem with positioning the milk bag 100 vertically is that it takes up too much room in the freezer or has a tendency to fall over. As such, to save space in the freezer, the milk bag 100 can be positioned horizontally. By positioning the milk bag 100 horizontally, the milk bag 100 can therefore be stacked on top of and/or below other milk bags. However, a problem with stacked milk bags is that they can become "stuck" because of frost. Another problem with stacked milk bags is that the top milk bag may slide off a bottom one; the frozen milk bag would have a deformed or awkward shape because of the way the milk bag slid off and landed prior to it being frozen. In addition, a frozen milk bag can have a shape that is off because of grates or other objects in the freezer. As parents, guardians, and caregivers know, frozen milk bags must be handled with care because the edges are delicate and can rupture if not handled with care; when defrosting the milk, the milk will become wasted as it will drip out of the punctured bag. Another problem with stacked milk bags is that it is difficult to retrieve a milk bag with the earliest date since it would be at a bottom of the stack and/or towards the back of the freezer. The desire is to use old milk first to avoid wasting such precious food since it has a suggested expiratory lifetime.

The present invention addresses these limitations in the prior art.

SUMMARY OF THE INVENTION

Embodiments of the present invention are directed to storage systems for milk bags. A storage system for milk bags receives milk bags and management of the stored milk bags. The milk bags are stored in compartments for easy storage and retrieval.

In one aspect, a storage system is provided. The storages system includes a plurality of shelves, and a housing sized to fit within a freezer space and configured to receive one or more of the plurality of shelves to form one or more compartments. Typically, each compartment is configured to store a storage bag.

In some embodiments, the housing is collapsible to adapt to the height of the freezer.

In some embodiments, each of the plurality of shelves includes high friction material around at least a portion of the perimeter of the shelf to engage interior surfaces of the housing. Alternatively or in addition to, the interior surfaces of the housing include high friction material to engage the one or more of the plurality of shelves.

In some embodiments, the measurement of the length of the housing is approximately the measurement of the height of a storage area of the storage bag, and wherein the measurement of the width of the housing is approximately the measurement of the width of the storage bag.

In some embodiments, the measurement of the length of each of the plurality of shelves is approximately the measurement of the height of a storage area of the storage bag, and wherein the measurement of the width of each of the plurality of shelves is approximately the measurement of the width of the storage bag.

In some embodiments, the measurement of the length of each of the plurality of shelves is approximately the measurement of the length of the housing, and wherein the measurement of the width of each of the plurality of shelves is approximately the measurement of the width of the housing.

In some embodiments, each of the plurality of shelves has a planar top surface. In some embodiments, each of the plurality of shelves has an uneven thickness to compensate for height difference of the storage bag having frozen liquid stored therein. In some embodiments, each of the plurality of shelves includes a flexible bottom surface to correspond with a shape of the storage bag having frozen liquid storage therein.

In some embodiments, a bottom portion of each of the plurality of shelves includes one of beads, gel and liquid. In some embodiments, each of the plurality of shelves is removable.

In some embodiments, each of the one or more compartments is triangular shaped, and wherein openings to the one or more compartments alternate between two ends of the housing. In some embodiments, the storage system further includes a protrusion extending from each of the one or more compartments, the protrusion configured to prevent the milk bag from sliding out of the respective compartment.

In some embodiments, the storage system further includes a plurality of markers each configured to couple with one of a shelf or the housing. In some embodiments, each of the plurality of markers is differently shaped or colored.

In some embodiments, each compartment includes a molding mechanism.

In another aspect, a method is provided. The method is of using a storage system including a plurality of shelves and a housing sized to fit within a freezer space and configured to receive one or more of the plurality of shelves to form one or more compartments, wherein each compartment is configured to store a storage bag. The method includes the housing receiving a storage bag horizontally placed therein, the housing receiving a shelf horizontally placed on top of the storage bag to create a compartment for the storage bag, and as the storage bag expands, the shelf rising until liquid in the storage bag completely freezes such that the compartment of the storage bag is sized specifically for the storage bag.

In some embodiments, the shelf contains material including one of beads, gel and liquid. In some embodiments, the method further includes settling the material within the shelf to conform to a shape of the storage bag beneath the shelf,

BRIEF DESCRIPTION OF THE DRAWINGS

Reference will now be made in detail to implementations of the present invention as illustrated in the accompanying drawings. The same reference indicators will be used throughout the drawings and the following detailed description to refer to the same or like parts.

DETAILED DESCRIPTION OF THE INVENTION

In the following description, numerous details are set forth for purposes of explanation. However, one of ordinary skill in the art will realize that the invention can be practiced without the use of these specific details. Thus, the present invention is not intended to be limited to the embodiments shown but is to be accorded the widest scope consistent with the principles and features described herein.

Embodiments of the present invention are directed to storage systems for milk bags. A storage system for milk bags receives milk bags and management of the stored milk bags. The milk bags are stored in compartments for easy storage and retrieval.

It should be understood that although milk and milk bags are described with respect to the storage systems of the present invention, other liquids and other types of bags are contemplated and can be used with the storage systems.

Although different storage systems will now be described, all storage systems can include material to prevent or minimize freezer burn.

Fixed Housing with Fixed Compartments

Figure 1:
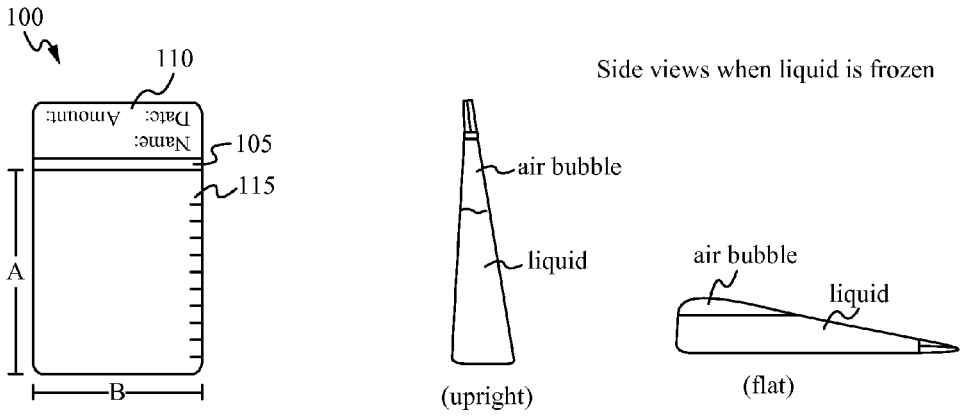
FIG. 1 illustrates an exemplary milk bag.
Figure 2:
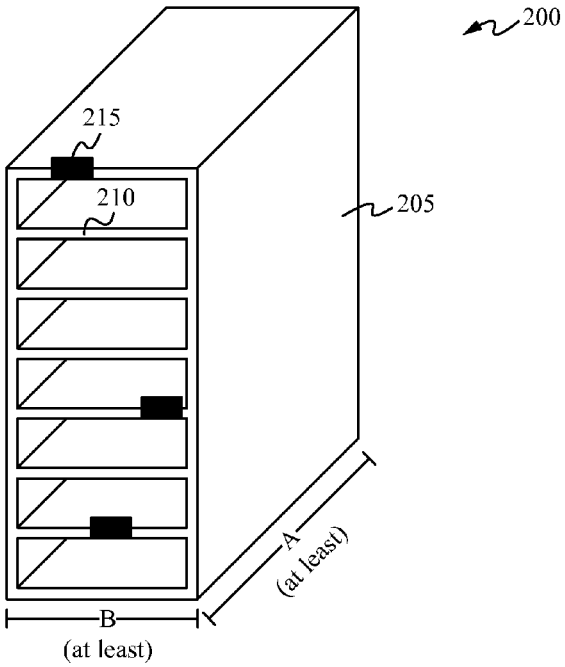
FIG. 2 illustrates an exemplary storage system in accordance with the present invention.

FIG. 2 illustrates an exemplary storage system 200 in accordance with the present invention. The storage system 200 typically fits within a freezer and includes a housing 205 having fixed compartments or units or slots, which are divided using shelves 210. Each compartment is sized and configured to receive a milk bag, such as the milk bag 100 illustrated in FIG. 1. The height of each compartment is fixed, although in some embodiments the shelves 210 are removable along tracks disposed on inner surfaces of the housing 205. In such an embodiment, the spacing of a compartment can be, for example, doubled by removing a shelf 210 or tripled by removing two shelves 210. Thus, the height of a compartment is incremented by a fixed factor. Without removing the shelves 210, the storage system 200 allows storage of x milk bags, with x being the number of compartments in the storage system 200.

When in use, milk bags are positioned horizontally within the compartments with the tags of the milk bags hanging out of the compartments so that information about the milk can be easily read. In some embodiments, additional information can be written on and erased from front sides or surfaces of the shelves 210.

In some embodiments, removable markers 215 can be used to indicate freshness of milk and other characteristics, such as if the mother drank coffee/tee/caffeinated drink, or if the mother ate some food that may have caused her to have heartburn, etc. The removable markers 215 typically clip with portions of the storage system 200, such as a shelf 210 or the housing 205. The removable markers 215 can vary in shape and color. For example, a mug-shaped marker can indicate that the mother drank a caffeinated drink prior to expressing milk. For another example, a blue-colored marker can indicate that the milk was expressed for ½ hour before being frozen. Other colors and shapes are contemplated.

In some embodiments, interior surfaces of the storage system 100 can include material to minimize or prevent freezer burn. For example, the material can be silicone or the like.

Fixed Housing with a Molding Mechanism

Figure 3:
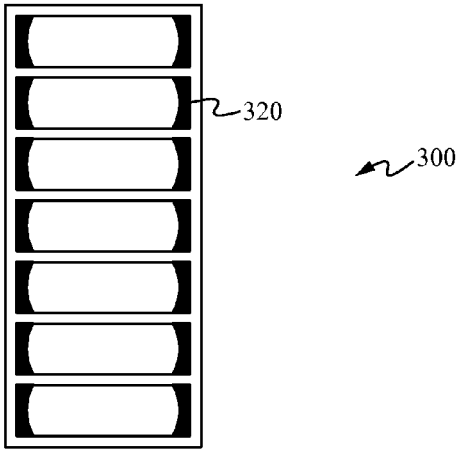
FIG. 3 illustrates another exemplary storage system in accordance with the present invention.

FIG. 3 illustrates another exemplary storage system 300 in accordance with the present invention. The storage system 300 is similarly configured to the storage system 200 except that each compartment includes molding mechanism 320 configured to mold the shape of a milk bag as the milk therein freezes. For example, each inner side of a compartment is concave such that the compartment has an oblong receptacle for receiving a milk bag. A frozen milk bag can be retrieved from the receptacle and placed in a mug, for example, to defrost.

Fixed Housing with Flexible Compartments

Figure 4A:
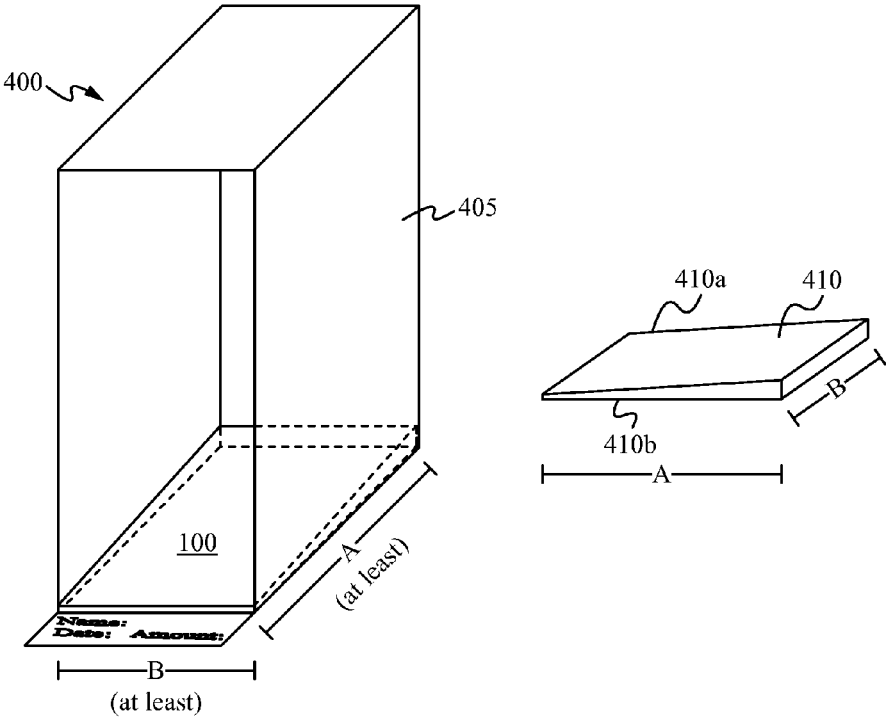
FIGS. 4A-4C illustrate yet another exemplary storage system in accordance with the present invention.

The amount of milk stored in a milk bag typically varies each time. There are times when not much milk is stored in a milk bag, while there are other times when more milk is stored in a milk bag. Compartments with fixed sizes do not allow additional milk bags to be stored therein and/or do not accommodate milk bags containing more milk. FIG. 4A illustrates another exemplary storage system 400 in accordance with the present invention. As further explained below, the storage system 400 advantageously allows more or less milk bags to be stored and allows milk bags with any amount of milk to be stored.

Figure 4B:
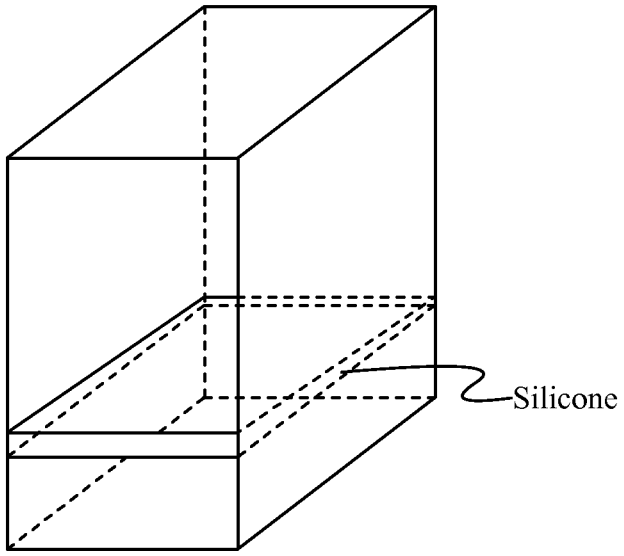

The storage system 400 typically fits within a freezer and includes a housing 405 and removable shelves 410. The storage system 400 does not have fixed compartments. Instead, a frozen milk bag defines the size of its respective compartment. In some embodiments, interior walls of the housing 405 and/or at least a portion of the perimeter of each shelf 410 include silicone or high friction material to engage the shelf 410 with the interior walls of the housing 405, as illustrated in FIG. 4B. Silicone can also help prevent or minimize freezer burn.

When in use, milk bags are positioned horizontally with a shelf 410 separating two consecutive milk bags. Put differently, a milk bag is placed horizontally in the housing 405, a shelf 410 is placed on top of it to thereby separate the milk bag from another, creating its own uniquely-sized compartment. As the milk freezes, the milk bag expands, pushing the shelf 410 upwards at a minimum distance, without wasting space in the housing 405 for other milk bags to be stored.

In some embodiments, a shelf 410 is weighted so that milk in a milk bag can be leveled within the milk bag. In some embodiments, a top portion 410*a* of the shelf 410 is flat and rigid to provide a level platform for the next milk bag to be placed on top of. In some embodiments, a bottom portion 410*b* of the shelf 410 is slanted or angled such that thickness of the shelf 410 at one end is not the same as the thickness of the shelf 410 at the other end to compensate for the uneven expansion of the milk. In some embodiments, the bottom portion 410*b* of the shelf 410 is flexible to compensate for the expansion of bag having any amount of milk to thereby provide the level platform for the next milk bag. For example, the bottom portion of the shelf includes beads or the like, such as gel or liquid, therein. The beads can be made of Styrofoam®.

In some embodiments, a shelf 410 is not weighted. Rather, a top weight is used to level the milk bag. In other words, in use, a first milk bag is placed horizontally in the housing 405. Then, a first shelf 410 is placed on top of the milk bag. Then, the top weight is placed on top of the first shelf 410. When putting another milk bag in the housing, the top weight is first removed before the another milk bag is placed on top of the first shelf 410. A second shelf 410 is placed on top of the another milk bag with the top weight placed on top of the second shelf 410. The top weight is able to be slightly smaller than the width and/or the length of the shelf 410, such that the top weight is able to make the milk bag level and even. In some embodiments, the top weight is similarly sized and shaped as a shelf 410.

Figure 4C:
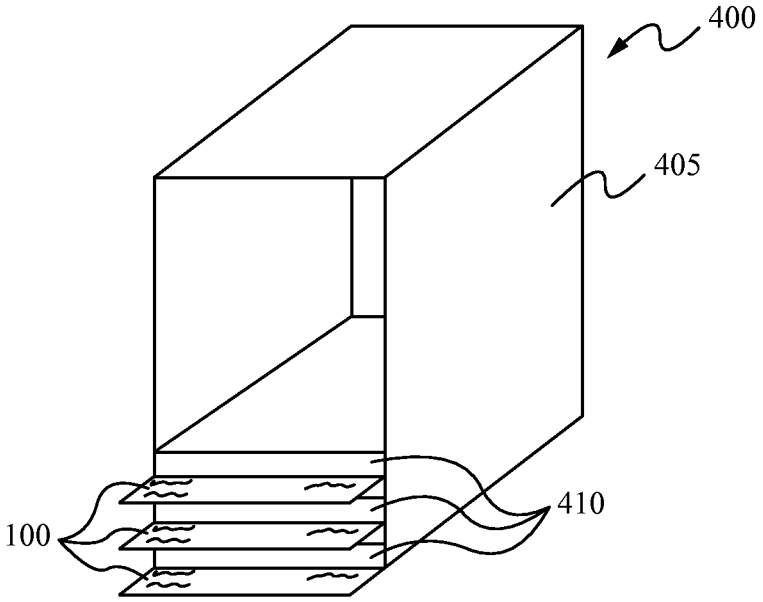

FIG. 4C illustrates a front view of the storage system 400 when in use. As illustrated in FIG. 4C, milk bags in the housing 405 are separated by shelves 410. The tags of the milk bags hang out of the housing 305 so that information about the milk can be easily read.

In some embodiments, markers similarly configured as the markers 215 can be used with the storage system 400. In some embodiments, front surfaces of the shelves 410 are configured to be marked with information, such as with a dry erase pen.

Unused shelves 410 can be stored separately or coupled to the housing 405. For example, a side of the housing 405 includes a protrusion, and each shelf 410 includes a hole configured to receive the protrusion. For another example, a side of the housing 405 includes clips to clip the shelves 410 to. Other mechanisms for coupling the shelves 410 to the housing 405 are contemplated.

Collapsible Housing

Figure 5:
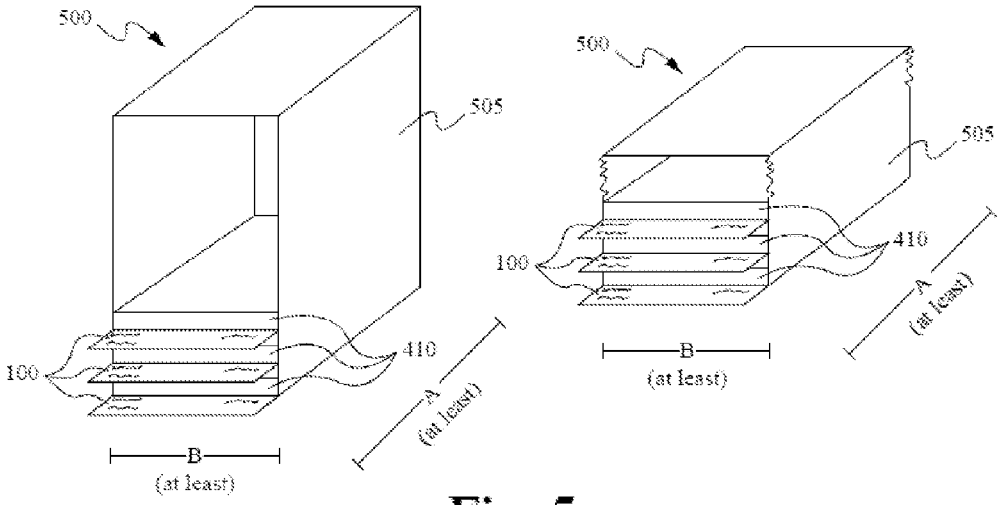
FIG. 5 illustrates yet another exemplary storage system in accordance with the present invention.

FIG. 5 illustrates yet another exemplary storage system 500 in accordance with the present invention. The storage system 500 includes a collapsible housing 505 and removable shelves (not illustrated). The storage system 500 is similarly configured as the storage system 400; for example, the shelves can be similarly configured as the shelves 410. However, the collapsible housing 505 advantageously accommodates any freezer size (e.g., height of freezer) because of its accordion like structure. For example, as illustrated in FIG. 5, the picture on the left shows the housing 505 fully expanded, with milk bags 100 in the housing 505 separated by shelves 410, while the picture on the right shows the housing 505 partially collapsed, with milk bags 100 in the housing 505 separated by shelves 410, to accommodate a smaller freezer space or to simply reduce its size/volume.

Framed Housing

Figure 6:
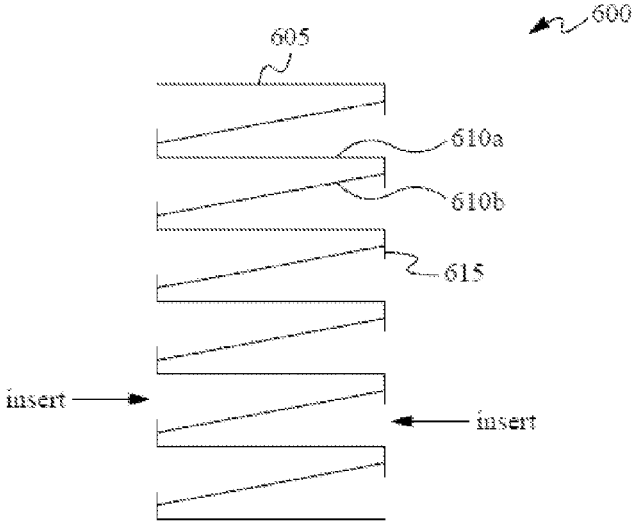
FIG. 6 illustrates yet another exemplary storage system in accordance with the present 6invention.

FIG. 6 illustrates yet another exemplary storage system 600 in accordance with the present invention. The storage system 600 includes a framed housing 605. The framed housing 605 includes a first end and second end, and planar dividers 610*a* and angular dividers 610*b* that form fixed slots with openings at both ends of the storage system 600 (e.g., tag end). The planar dividers 610*a* and angular dividers 610*b* form triangular-shaped compartments.

Milk bags are inserted from both ends, with the top of the milk bag inserted in the housing 605 first. In some embodiments, there are tooth-like features 615 that protrude from each shelf to "hold back" a milk bag so that it doesn't slide out. In some embodiments, each tooth-like feature 615 extends from an end of an angular divider 610*b* towards a planar divider 610*a*.

In some embodiments, the tooth-like features 615 are configured to be marked with information. In some embodiments, markers similarly configured as the markers 215 can be used with the storage system 600.

Rolodex-Like Housing

Figure 7:
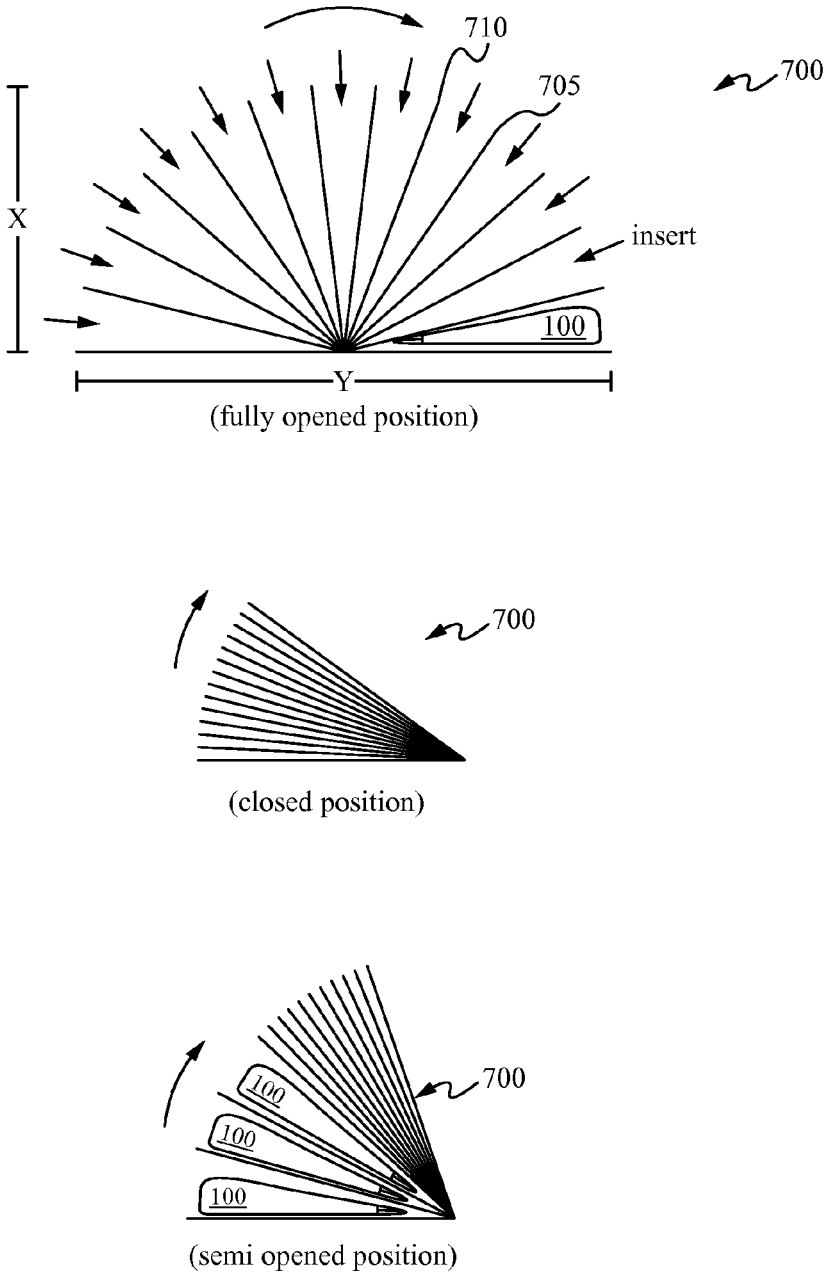
FIG. 7 illustrates yet another exemplary storage system in accordance with the present 6invention.

FIG. 7 illustrates yet another exemplary storage system 700 in accordance with the present invention. The storage system 700 typically fits within a freezer and includes a rolodex-like housing 705 with having fixed compartments or units or slots, which are divided using shelves 710. Each compartment is wedge-shaped and is sized and configured to receive a milk bag, such as the milk bag 100.

In some embodiments, each compartment includes a molding mechanism, such as the molding mechanism 230, to mold the shape of a milk bag as the milk therein freezes.

In some embodiments, the storage system 700 is able to be configured in a closed position, in a fully opened position, and a semi opened position which is any position the closed configuration and the fully opened configuration. When the storage system 700 is in the fully opened configuration, all the compartments open up like a fan.

In a fully opened configuration, the storage system 700 has a height X and a diameter Y. If the height of a freezer is smaller than X or if the depth of the freezer is smaller than Y, then the storage system 700 need not be in the fully opened configuration for the storage system 700 to be used. Instead, the storage system 700 is opened to a configuration permitted by the dimensions of the freezer.

As the storage system 700 opens, a compartment opens up to receive a milk bag. Typically, each shelf is substantially planar and rigid. Each shelf can include a tab for easily opening up to a respective compartment. In some embodiments, the tab is coupled to the front of the shelf.

Bare Housing

Figure 10:
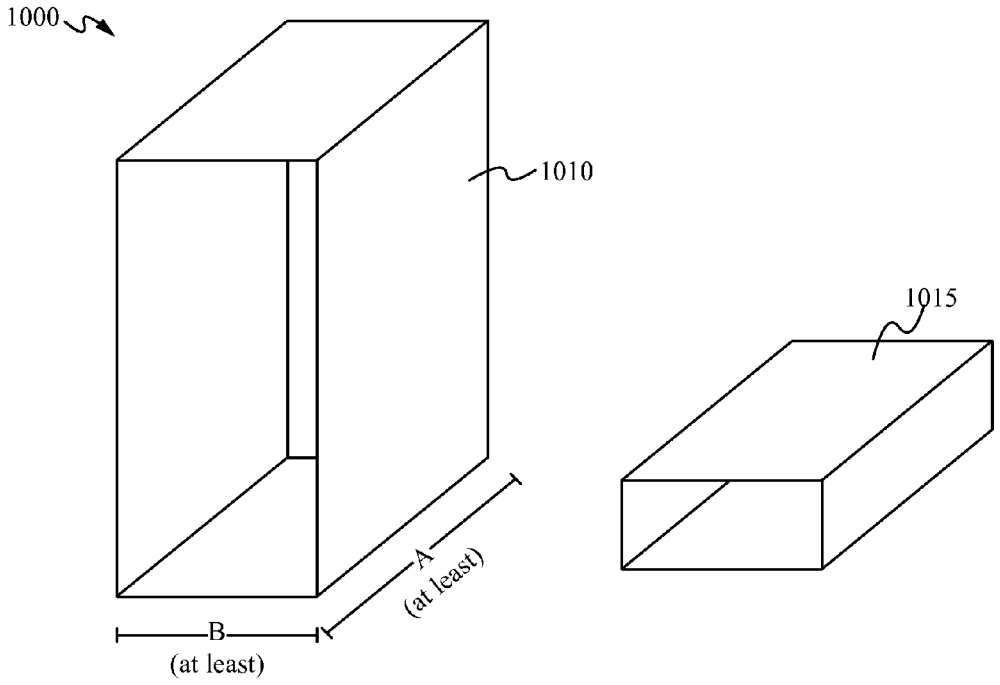
FIG. 10 illustrates yet another exemplary storage system in accordance with the present 6invention.

FIG. 10 illustrates yet another exemplary storage system 1000 in accordance with the present invention. The storage system 1000 typically fits within a freezer and includes a bare housing 1005 with no shelves. Instead, the storage system 1000 includes removable compartments 1010. Each compartment 1010 is sized and configured to be received by the housing 1010. Each compartment 1010 is also sized and configured to receive a milk bag. In some embodiments, the housing 1010 is collapsible.

When storing a milk bag, the milk bag is inserted into a compartment 1010. Typically, the tag of the milk bag hangs out. When milk is desired, an entire compartment 1015 can be removed from the storage system 1000. The milk bag need not to be removed from the compartment 1010 since the compartment 1010 can advantageously be used as a container to defrost the milk bag in. Alternatively, a frozen milk bag can be removed from the compartment 1010 while the compartment 1010 is left in the storage system 1000.

The storage systems discussed in relation to FIGS. 2-7 and 10 allow a frozen milk bag to be stored in an organized manner for, among other things, easy retrieval. Furthermore, since the milk bags are organized within the storage system, donating frozen milk via shipment becomes more convenient since the entire storage system can be shipped. In some embodiments, the storage system includes a handle for transportation. In some embodiments, the storage system is made from durable, yet light weight material. In some embodiments, the storage system is made of silicone or other material to prevent milk from over-freezing and/or to equalize temperature within the storage system.

Using a Storage System

Figure 8:
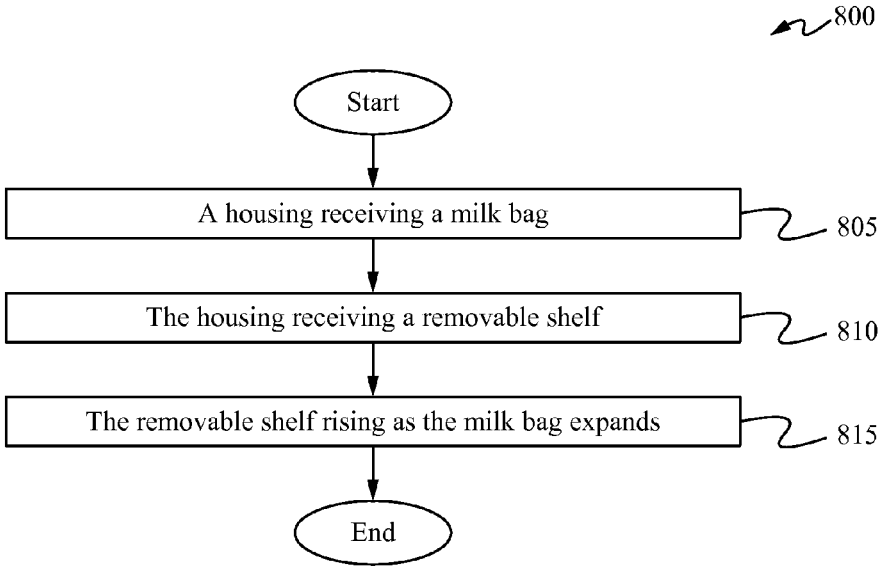
FIG. 8 illustrates an exemplary method of using one of the storage systems of FIGS. 4A-4C and 5 in accordance with the present invention.

FIG. 8 illustrates an exemplary method 800 of using one of the storage systems 400, 500 in accordance with the present invention. The method 800 begins at a step 805, where the storage system, particularly its housing, receives a bag such as a milk bag. The milk bag contains a liquid, such as milk. The milk bag is placed horizontally within the housing of the storage system. If this milk bag is the first milk bag to be stored in the storage system, then it is placed on an inner surface of the housing at the bottom of the housing. If this is milk bag not the first milk bag in the storage system, then it is placed on a shelf. If a separate weight is used, the separate weight is removed prior to the placement of the milk bag in the storage system. After the milk bag is placed within the storage system, either as the first milk bag or a subsequent milk bag in the storage system, at a step 810, a shelf is placed on top of the horizontally placed milk bag. The shelf typically has a rigid planar top surface for level placement of a subsequent milk bag and an angled bottom surface to compensate for the uneven expansion of milk within the milk bag. In some embodiment, the shelf is weighted for leveling the milk in the milk bag. In some embodiments, the shelf is not weight. In some embodiments, the separate weight is placed on top of the shelf to thereby level the milk in the milk bag. At a step 815, as the milk bag expands, the shelf rises or is otherwise pushed upwards until the milk in the milk bag freezes. Adjustable compartments for the milk bags are created by using shelves that move upwards within the storage system as milk in the milk bags freezes. A compartment of a storage bag is advantageously sized specifically for the storage bag. After the step 815, the method 800 ends.

The method 800 can be repeated for each milk bag to be stored until there no longer is sufficient space for the storage of an additional milk bag.

Thawing Container

Figure 9:
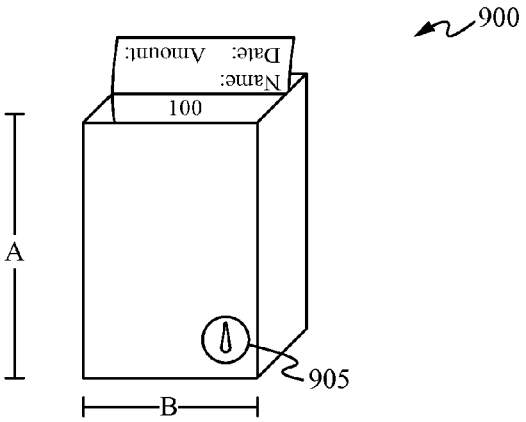
FIG. 9 illustrates an exemplary thawing container 700 in accordance with the present invention.

FIG. 9 illustrates an exemplary thawing container 900 in accordance with the present invention. The thawing container 900 is configured to receive a frozen milk bag for defrosting. In some embodiments, the thawing container 900 includes an indicator for indicating how long the milk has been thawing, how much longer the milk needs to thaw, or both.

Water can be added in the thawing container 900 to speed up the thawing. In some embodiments, the thawing container 900 also includes an electronic warmer configured to speed up the thawing process.

In some embodiments, the thawing container 900 fits within a storage system housing, such as the housing 1005.

One of ordinary skill in the art will realize other uses and advantages also exist. While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

We claim:

1. A storage system comprising:

a plurality of storage bags, wherein each of the plurality of storage bags is for containing content therein;

a plurality of shelves, wherein at least one of the plurality of shelves is vertically movable within the storage system as the content in one of the plurality of storage bags positioned beneath the at least one of the plurality of shelves undergoes a phase change, wherein the at least one of the plurality of shelves has a non-uniform thickness such that a bottom surface of the at least one of the plurality of shelves is in direct contact with a storage bag located beneath the at least one of the plurality of shelves to compensate for an uneven expansion of the storage bag as the content stored therein undergoes a phase change, wherein the bottom surface of each of the plurality of shelves includes one of beads, gel and liquid; and a housing with collapsible side walls such that, when in use, the walls are extendable such that the housing fits within a first freezer space that has a first height dimension and such that the walls are compressible to fit within a second freezer space that has a second height dimension smaller than the first height dimension of the first freezer space, and wherein the housing is configured to receive the plurality of shelves through an opening of the housing to form a plurality of compartments to store the plurality of storage bags, wherein the opening allows for removal of a first of the plurality of storage bags without removal of a second of the plurality of storage bags such that, upon removal of the first of the plurality of storage bags, a position of the second of the plurality of storage bags changes within the housing.

2. The storage system of claim 1, wherein each of the plurality of shelves includes high friction material around at least a portion of the perimeter of the shelf to engage interior surfaces of the housing.

3. The storage system of claim 1, wherein interior surfaces of the housing include high friction material to engage the one or more of the plurality of shelves.

4. The storage system of claim 1, wherein, when in use, the measurement of the length of the housing is approximately the measurement of the height of a storage area of the storage bag, and wherein, when in use, the measurement of the width of the housing is approximately the measurement of the width of the storage bag.

5. The storage system of claim 1, wherein each of the plurality of shelves has a planar top surface.

6. The storage system of claim 1, wherein each of the plurality of shelves has an uneven thickness to compensate for height difference of the storage bag having frozen liquid stored therein.

7. The storage system of claim 1, wherein each of the plurality of shelves includes a flexible bottom surface to correspond with a shape of the storage bag having frozen liquid storage therein.

8. The storage system of claim 1, wherein, when in use, the measurement of the length of each of the plurality of shelves is approximately the measurement of the height of a storage area of the storage bag, and wherein, when in use, the measurement of the width of each of the plurality of shelves is approximately the measurement of the width of the storage bag.

9. The storage system of claim 1, wherein, when in use, the measurement of the length of each of the plurality of shelves is approximately the measurement of the length of the housing, and wherein, when in use, the measurement of the width of each of the plurality of shelves is approximately the measurement of the width of the housing.

10. The storage system of claim 1, wherein each of the plurality of shelves is removable.

11. The storage system of claim 1, further comprising a plurality of markers each configured to couple with one of a shelf or the housing.

12. The storage system of claim 11, wherein each of the plurality of markers is differently shaped or colored.

13. A storage system comprising:

a plurality of storage bags, wherein each of the plurality of storage bags is for containing content therein; a plurality of shelves, wherein at least one of the plurality of shelves is vertically movable within the storage system as the content in one of the plurality of storage bags positioned beneath the at least one of the plurality of shelves undergoes a phase change, wherein the at least one of the plurality of shelves has a sloped bottom surface that is in direct contact with a storage bag located beneath the at least one of the plurality of shelves to compensate for an uneven expansion of the storage bag as the content stored therein undergoes a phase change, wherein the bottom surface of each of the plurality of shelves includes material that conforms to the shape of the storage bag located beneath the at least one of the plurality of shelves; and a housing with collapsible side walls such that, when in use, the walls are extendable such that the housing fits within a first freezer space that has a first height dimension and such that the walls are compressible to fit within a second freezer space that has a second height dimension smaller than the first height dimension of the first freezer space, and wherein the housing is configured to receive the plurality of shelves through an opening of the housing to form a plurality of compartments to store the plurality of storage bags, wherein the opening allows for removal of a first of the plurality of storage bags without removal of a second of the plurality of storage bags such that, upon removal of the first of the plurality of storage bags, a position of the second of the plurality of storage bags changes within the housing.

* * * * *